United States Patent [19]

Pillosio

[11] 4,054,033

[45] Oct. 18, 1977

[54] RETAINING PANEL

[75] Inventor: Roberto Pillosio, Feletto Umberto, Italy

[73] Assignee: Pilosio, S.p.A., Feletto Umberto, Italy

[21] Appl. No.: 662,439

[22] Filed: Mar. 1, 1976

[30] Foreign Application Priority Data

Mar. 10, 1975 Italy ..... 60333/75
Jan. 27, 1976 Italy ..... 60322/76

[51] Int. Cl.[2] ..... E21D 5/00
[52] U.S. Cl. ..... 61/41 A; 52/615; 403/345
[58] Field of Search ..... 61/41 A; 52/615, 620, 52/309, 404, 580, 613; 403/345, 361

[56] References Cited

U.S. PATENT DOCUMENTS

| | | | |
|---|---|---|---|
| 3,204,415 | 9/1965 | Hill, Jr. et al. | 61/41 A |
| 3,621,660 | 11/1971 | Krings | 61/41 A X |
| 3,750,410 | 8/1973 | Converse | 61/41 A |
| 3,858,399 | 1/1975 | Krings | 61/41 A |
| 3,910,054 | 10/1975 | Krings | 61/41 A |
| 3,937,026 | 2/1976 | Krings | 61/41 A |
| 3,969,852 | 7/1976 | Krings | 61/41 A |

*Primary Examiner*—Jacob Shapiro
*Attorney, Agent, or Firm*—Stevens, Davis, Miller & Mosher

[57] ABSTRACT

The invention discloses a trench shoring panel is having an internal construction form made with continuous longitudinal elements connected vertically by analogous vertical elements suitably spaced. This panel has at its vertical sides at least one vertical end slot on one of its sides and on its other side a vertical projection that cooperate with said slot.

10 Claims, 5 Drawing Figures

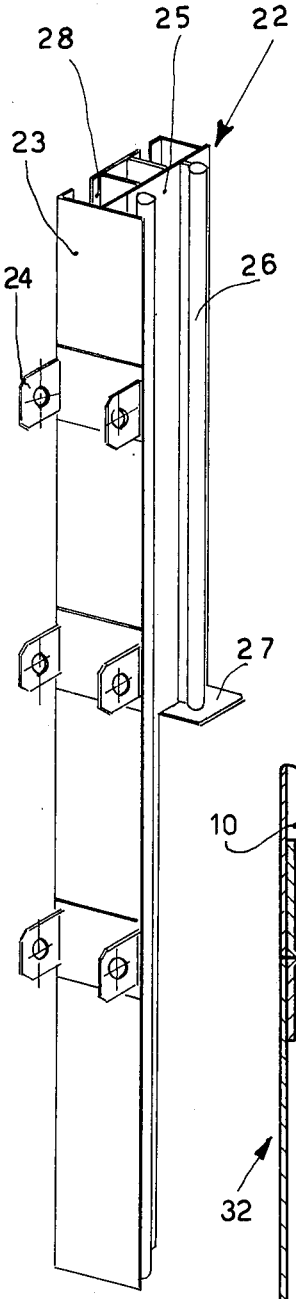
fig. 3
fig. 5
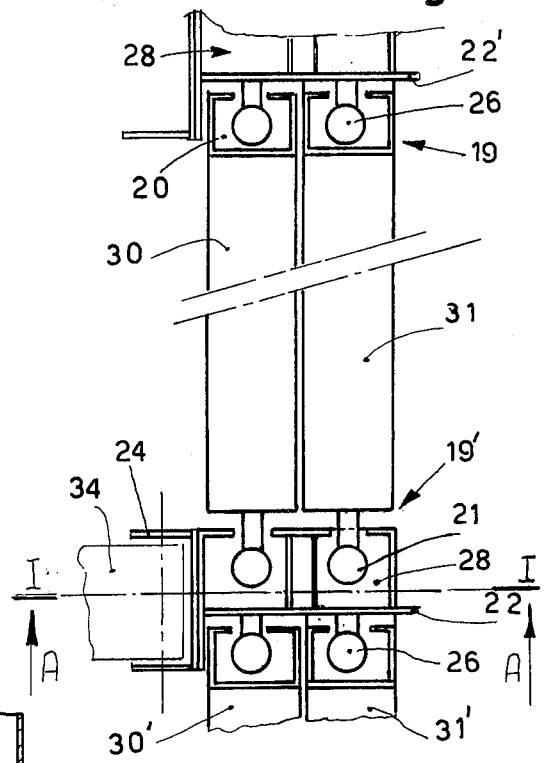
fig. 2
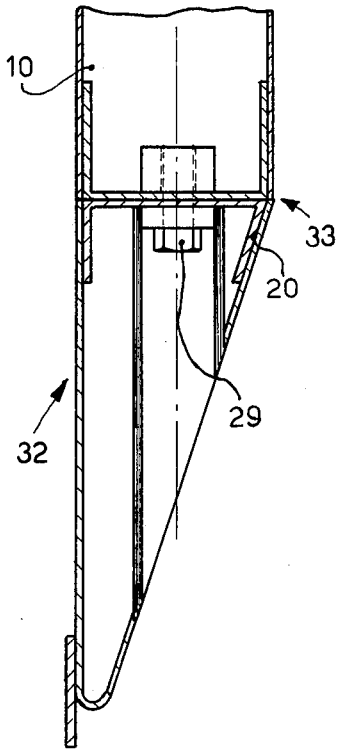
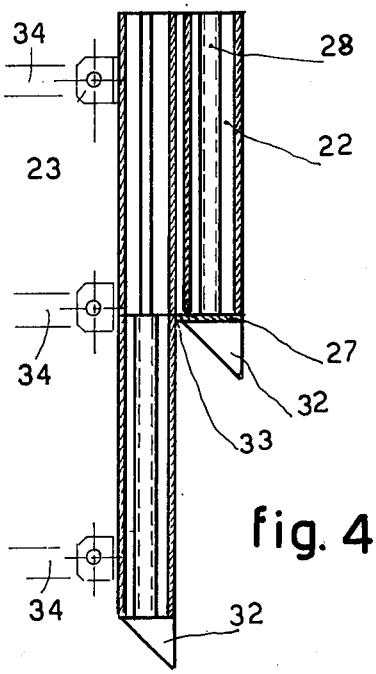
fig. 4

RETAINING PANEL

The subject of this invention is a new retaining panel for trench excavations.

It is known that in the case of trench excavations for the laying of pipes, cables, etc., where the depth of the trench may even reach a level of several meters, there is always the danger of the earth moving, with consequent landslides falling to the bottom of the excavation. If the excavation is deep and personnel have to work therein, a landslide might have disastrous consequences with loss of human lives.

To prevent this from happening, bulkheads are erected at the sides of the excavation and are held at the desired distance with struts.

The panel of this invention serves to realize combinable bulkhead units of any desired height.

Panels of this type are known; they are made of metal with a box-like structure in various heights and lengths and they cooperate normally with vertical guides which secure them vertically at their ends.

The known panels involve a series of problems, among which is the fact that they need independent vertical guides; they do not cooperate directly with the struts and they need several men for their installation.

The present invention avoids these and other problems by proposing a new retaining panel for use in trenches. In accordance with the invention the proposed panel has an internal constructional form made up with continuous longitudinal elements connected vertically by analogous vertical elements suitably spaced and has at its vertical sides at least one vertical end slot on one of its sides and on its other side an appropriate vertical projection that cooperates with said slot.

In accordance with a variant of this formulation the slot may have a T-shaped cavity, with which bayonet means at the opposed end cooperate; this arrangement enables one panel to be connected both to the next panel and to the preceding panel without any need of intermediate auxiliary couplings.

A further variant arranges for some vertical guides, which serve as intermediaries between two panels and at the same time serve for the anchorage of adjustable strut elements, which are used as spacer means between two walls opposite to each other in a trench.

The ends of the adjustable struts are fixed to the guides with pins. The lower part of the panel is normally shaped like a "V" and may also be envisaged as being removable.

All the above, together with other devices, contributes towards making the panels new and more useful and also easier to use.

The above will now be better described by making use of the attached tables, which are provided for non-limitative purposes and wherein:

FIG. 2 shows a variant of the lower part of the panel.

FIG. 3 shows a vertical guide with two columns.

FIG. 4 and 5 show the application of the guide of FIG. 3, FIG. 4 giving a vertical view while FIG. 5 gives a plan view.

Hereinafter, the same parts or parts performing the same functions are given the same reference numbers.

Figure 1:
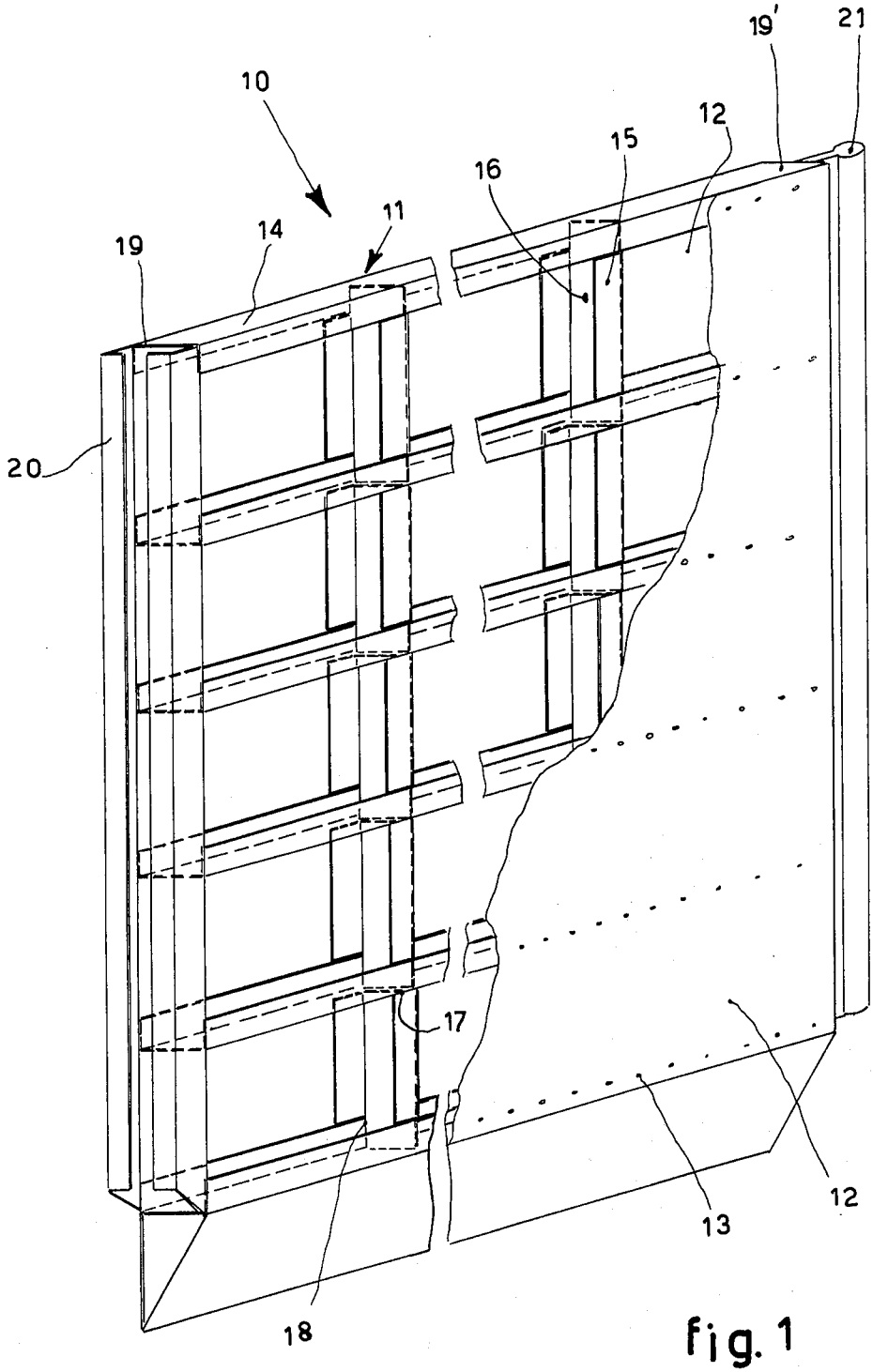
FIG. 1 shows a parial horizontal section of a vertical panel together with the ends of the panel itself.

With reference to FIG. 1 and the subsequent FIGS. we have as follows: 10 is generically the retaining panel, having a box-like structure and consisting of the carrying structure 11, which in our example is covered on both sides with sheets of steel plate 12, which are joined to it with studs or rivets or by means of spot welding or intermittent welding; 14 is generically the longtitudinal structural steel member of said carrying structure 11 and in our example has the form of a "C" turned to face upwards, except in the case of the last upper member, but could be turned to face downwards, except in the case of the last lowest member; the structural steel member 14 runs longtitudinally along the whole panel from one side to the other without any true break in continuity; 15 is generically the transverse structural member, being of the same type and having the same width as the longtitudinal member 14; it has, at least at one end, its ribs cut away so as to form a tongue 16, which is inserted into the member 14, and it is then fixed along the profile of its upper 17 and lower 18 ends to said horizontal members 14 by means of welding. 19 and 19' are the vertical heads, front and rear respectively, of the panel 10; 20 is the female coupling element and consists, in our example, of a T-shaped hollow in said front head 19, said hollow being required to lodge and hold the male coupling means 21 at the other side of the panel or the male coupling means 26 of the guide 22; 21 is the male coupling element and consists, in our example, of a cylindrical element, which is present on said rear head 19' and is introduced either into the hollow 28 of the guide 22 constituting here the female coupling or into the hollow 20 present in the head of the preceding or subsequent panel. 22 is generically the guide or joint, which may be single or double, it is suitable for securing two panels side by side or substantially side by side, as shown in FIG. 3 as an example; said guide consists substantially of a T-shaped member on whose head surface 23 there are the points 24 to anchor the ends of adjustable or non-adjustable struts 34 of a known type. 25 is the stem of the "T" and has on one side one or more male coupling elements 26, which are realized in our example by means of a cylindrical element like the coupling element 21 of the panel but which could be obtained with T-shaped means or with another similar or comparable means, whereas in the case of a double guide (as shown in FIG. 3) there is at least one male coupling element — preferably that farther from the head 23 — which is limited vertically to substantially the upper half of the height of the guide and which may have at its bottom end some means 27 to stop vertical movement of the panel 10, said means 27 consisting of a plate in our example. 28 are the female coupling elements of the guide 22 and, in our example, consist of a T-shaped hollow to lodge and hold the male coupling element 21 present on the rear head 19' of the panel 10; said hollows may have a different shape to suit the form of the male coupling element, and at least one hollow — preferably the rear hollow — is limited to the upper half of the height of the panel and may be provided at its lower end with means 27 to sustain the panel 10, which consist, in our example, of a plate; moreover, the male coupling elements 26 are substantially centred in respect of the female coupling elements 28, and each male/-female pair is substantially centred in respect of the points 24 for connecting the transverse struts 34; the hollows 28 are substantially equal to or like the hollows 20. 30 and 30' are, in our example, the lower panels, whereas 31 and 31' are the higher panels whenever a double guide 22 is used; 32 is the terminal V-shaped element of said panels, while 33 is its upper attachment edge; 34 is the strut element to sustain the panel transversely, being of a know type and capable of being adjusted longtitudinally; 29 are connection means provided when the element 32 is removable.

Let us now see the method of functioning when double guides are being used. The double guides 22 and 22', respectively the front and the rear guides, are positioned at the required distance apart, being sustained and positioned transversely by means of struts 34 fixed to them at the points 24. Next, a panel 10 is placed between said guides 22, its front head 19 (see FIG. 5) facing the male element 26 of the front guide 22', while its rear head 19' that bears the male element 21 is turned towards the rear guide 22 and thus corresponds with the female element 28 thereof. The panel is centred on the longer couplings, these latter being those closest to the head 23 of the guide in our example. The panel is then lowered and the hollow 20 is caused to slide over the male coupling 26, while the male coupling 21 slides into the hollow 28 of the rear guide 22. Being lowered in this way, the panel takes up the position marked 30 or else 30' in FIG. 5 and penetrates with its terminal V-shaped element 32 into the ground. A second panel 10 is then lowered and is aligned with the other pair of couplings in the joints 22. This second panel 10 will slide on the guides 26–28 of the joints 22 and will stop half-way down when it rests with its rear head 19' on the stop 27 in the hollow 28 of the guide 22 and with its front head 19 on the stop 27 positioned below the male coupling element 26 of the front joint 22'. Thus the panel takes up the position 31 or else 31' in FIG. 5 and, in practice, comes to rest with the upper attachment edge 33 of the V-shpaped terminal element resting on the outer upper surface of the panel 30. Positioned in this way, the panel withstands the stresses in a satisfactory manner owing to its reticular, single angle bar structure, as shown in FIG. 1. Said structure is realized by arranging between two C-shaped horizontal structural angle bars 14 some vertical C-shaped structural angle bars 15 prepared previously. The preparation of the angle bars 15 is carried out, in the example of FIG. 1 by removing the ribs at the lower end 18, thus obtaining the tongue 16, and also removing the ribs at the upper end 17 of the last upper row of angle bars in particular. The tongue 16 is inserted normally in the horizontal angle bar 14 within the C-shaped cavity of the latter, welding then being carried out on the upper 17 and lower 18 edges of said angle bars pre-disposed in a vertical and aligned manner.

The structure thus acquires special vertical and horizontal strength without any break in continuity in the two directions.

We have described here a preferential realization of the invention, but variants may be applied by an expert in this field without departing thereby from the scope of the idea of the solution.

Thus it is possible to modify the proportions and sizes of the individual parts; it is possible to use H-shaped angle bars in place of C-shaped bars; it is likewise possible to vary the form of the male and female coupling elements; it is possible to arrange for the couplings which extend outwards and for those which are limited to the top to extend inwards in respect of the points 24; it is also possible for the connecting points 24 for the struts 34 to be off centre in respect of the plane of separation of the male and female elements 26 and 28 of the guide 22; it is possible for the means 27 halting the panel to consist of pins or screws and for said means 27 to be lacking, the support being made of welding material externally; all these variants are possible without departing thereby from the scope of the idea of the solution.

I claim:

1. An excavated wall retainer comprising vertical guides, at least one retaining panel, each said guides consisting of a substantially T-shaped section to which is attached on the outer side of the head of the T in spaced relationship strut anchoring means and to which is attached on one side of the stem of the T two adjacent male connection means and on the other side of the stem of the T two adjacent female connection means, one pair of male and female connection means extending the entire height of the guides, one pair of male and female connection means extending only on the upper one-half of said guides, said retaining panel comprising an inner carrying structure composed of vertical sections and horizontal sections connected to each other and at least one covering surface for one side of said structure, one outer vertical section defining a male connection means, one outer vertical section defining a female connection means and means to stop one of said panels from moving the entire height of said guide, said panel being vertically slidable within one pair of said male and female connection means for its full height.

2. The wall retainer of claim 1 wherein said strut anchoring means are aligned in respect of each pair of male/female connection means.

3. The wall retainer of claim 1 wherein the male connection means are aligned with the female connection means.

4. The wall retainer of claim 1 wherein said stop means for the panel consist of plates fixed to the lower ends of one pair of male and female connection means.

5. The wall retainer of claim 1 wherein the female connection means is a hollow T-shape.

6. The wall retainer of claim 1 wherein the horizontal and vertical sections are C-shaped sections.

7. The wall retainer of claim 1 wherein the horizontal and vertical sections are H-shaped sections.

8. The wall retainer of claim 6 wherein the vertical sections have their ribs cut off at least at one end thus forming a tongue.

9. The wall retainer of claim 1 wherein the male connection means is a tubular element.

10. The wall retainer of claim 1 wherein the female connection means is a hollow T-shape.

* * * * *